United States Patent [19]

Burwell

[11] Patent Number: 4,815,096

[45] Date of Patent: Mar. 21, 1989

[54] COOLING SYSTEM AND METHOD FOR MOLTEN MATERIAL HANDLING VESSELS

[75] Inventor: William H. Burwell, Olmsted Falls, Ohio

[73] Assignee: Union Carbide Corporation, Danbury, Conn.

[21] Appl. No.: 165,609

[22] Filed: Mar. 8, 1988

[51] Int. Cl.[4] ..... F27D 1/12

[52] U.S. Cl. ..... 373/74

[58] Field of Search ..... 373/71–76; 266/280, 286; 432/248; 110/336

[56] References Cited

U.S. PATENT DOCUMENTS

| | | | |
|---|---|---|---|
| 1,840,247 | 1/1932 | Northrup . | |
| 3,388,737 | 6/1968 | Buckwalter et al. | 164/283 |
| 3,429,973 | 2/1969 | Carter et al. . | |
| 3,858,861 | 1/1975 | Jernigan | 266/32 |
| 4,107,449 | 8/1978 | Sosonkin et al. . | |
| 4,132,852 | 1/1979 | Andoniev et al. . | |
| 4,216,348 | 8/1980 | Greenberger . | |
| 4,239,484 | 12/1980 | Schuster | 432/77 |
| 4,273,949 | 6/1981 | Fischer et al. . | |
| 4,297,422 | 4/1980 | Fuchs et al. . | |
| 4,345,332 | 8/1982 | Wronka | 373/74 |
| 4,443,188 | 4/1984 | Buhler | 432/233 |
| 4,494,594 | 1/1985 | Kuzinski | 164/443 |
| 4,633,480 | 12/1986 | Bleimann | 373/74 |
| 4,715,042 | 12/1987 | Heggart et al. | 373/74 |

FOREIGN PATENT DOCUMENTS

| | | |
|---|---|---|
| 1108372 | 10/1957 | Fed. Rep. of Germany . |
| 3027465 | 3/1982 | Fed. Rep. of Germany . |
| 45-29728 | 9/1970 | Japan . |
| 57-48615 | 10/1982 | Japan . |

OTHER PUBLICATIONS

Spray Tech Mold System, George Hess, Syracuse, USA, Wold Steel and Metalworking, vol. 7, 85/86.

*Primary Examiner*—Roy N. Envall, Jr.

*Attorney, Agent, or Firm*—Cornelius F. O'Brien

[57] ABSTRACT

A vessel for handling a heated substance such as molten materials, and a method for cooling such a vessel, the vessel having fluid cooled containment means comprising inner and outer walls defining a space therebetween; an inlet into the space for a pressurized fluid coolant; means for spraying the coolant against the inner wall to maintain a desired temperature at the inner wall; an outlet for removing the spent coolant; and means for establishing and maintaining a pressure differential between the space and the coolant outlet to force the spent coolant out of the space through the outlet. The preferred embodiment of the invention is utilized as a roof or side wall for a metallurgical vessel, for example, an electric arc furnace.

25 Claims, 3 Drawing Sheets

COOLING SYSTEM AND METHOD FOR MOLTEN MATERIAL HANDLING VESSELS

BACKGROUND OF THE INVENTION

This invention relates to an improved vessel for containing and handling molten materials and a method for cooling such a vessel. The invention is directed particularly to covers for vessels for molten metals such as melt furnaces, ladles and the like.

Prior art systems for containing molten materials, and in particular, molten metals, have relied on refractory lining or water cooling or a combination of both to protect the walls, bottom and covers of such vessels from the high temperature generated by the molten materials and off-gases. In the case of molten metals such as steel, these temperatures may be in excess of 2800° F. (1540° C.).

Refractory linings installed in such vessels are costly and have short lives, even where such linings are utilized above the melt line of the vessel. Although water has been utilized to cool the inner surfaces of these vessels (generally made from structural steel plate) it has been the usual practice to utilize closed systems in which pressurized water completely fills circulating passages within the vessel walls, roof, etc. These systems generally necessitate high volumes of water at relatively high pressures. "Hot spots" created on the inner wall by blockage of coolant water can lead to flashing of the water to steam and rupture of the containment structure. Once leakage occurs in the inner walls of the vessel, the flow of the cooling water into the molten material can lead to serious hazards such as explosions due to the water flashing to steam or other adverse reactions. These problems create serious hazards to life and equipment in addition to damage to the molten material being processed. Other prior art systems which seek to alleviate such problems utilize complex, costly and difficult-to-maintain equipment which is clearly not desirable in the surrounding area and environment of steel furnaces and other molten material handling vessels.

Bearing in mind these and other disadvantages of the prior art, it is therefore an object of the present invention to provide a relatively lightweight, simple yet effective system for cooling the roof, walls and other containment surfaces of vessels used in handling molten materials, especially melt furnaces.

It is another object of the present invention to provide such a system which, in case of error, minimizes the risks of injury to life and equipment.

It is a further object of the present invention to provide an improved system which reduces the volume of coolant needed within the containment roof and/or walls of a molten material handling vessel.

It is yet another object of the present invention to provide a cooling system which eliminates the need for an installed refractory thermally insulating lining on the interior of the containment roof of such vessels.

SUMMARY OF THE INVENTION

The above and other objects, which will be apparent to those skilled in the art, are achieved in the present invention which provides a vessel for molten materials, the vessel having fluid cooled containment means comprising inner and outer walls defining a space therebetween; an inlet into the space for a pressurized fluid coolant; means for spraying the coolant against the inner wall to maintain a desired temperature at the inner wall; an outlet for removing the spent coolant; and means for establishing and maintaining a pressure differential between the space and the coolant outlet to force the spent coolant out of the space through the outlet.

In another aspect, the present invention provides a method of cooling a vessel for molten materials, the vessel including fluid cooled containment means comprising inner and outer walls defining a space therebetween and an inlet and outlet in the space for the fluid coolant, the method comprising the steps of: (a) injecting a pressurized fluid coolant through the inlet into the space; (b) spraying the coolant against the inner wall to maintain a desired temperature at the inner wall; and (c) simultaneously maintaining a pressure differential between the space and the fluid outlet to force spent coolant out of the space through the outlet.

The preferred embodiment of the invention is utilized as a roof or cover for a metallurgical vessel, for example, an electric arc furnace. The spent coolant is preferably forced out of the interior space between the roof inner and outer walls by a system which injects a gas such as air or nitrogen at a pressure above atmospheric but between that of the pressurized coolant and the coolant outlet to positively displace the coolant. When such covers are utilized on tilting vessels, a plurality of coolant outlets are employed, along with means for determining when one outlet is elevated above another outlet. During tilting, the elevated outlet is closed to prevent depressurization of the interior of the cover. The underside of the roof includes hollow tubular projections extending from the inner wall toward the interior of the furnace to trap and retain solidified portions of molten material, for example, spattered slag, which contact the roof underside to provide a more adherent in-situ formed, thermally insulating lining which reduces thermal shock to the roof. By properly forming an in-situ lining of insulating slag on the underside of the inner wall and securing such slag to said undersurface of the inner wall, the roof can be removed for charging or the like and positioned back on the furnace without loss of the insulating slag liner. This will protect the inner wall from exposure to large temperature variation and thereby effectively minimize thermal shock which could result in stress cracking of the inner wall. The use of hollow tubular projections can trap the spattered slag in and around the tubular projections so as to provide an anchor for the slag lining that will then remain secured to the undersurface of the inner wall of the roof even when the roof is moved.

The system of the invention is highly efficient, using significantly less cooling water than water flooded systems. For instance, in one example using the system of the invention, only about one half as much coolant is used as in a typical prior art water flooded system. This significant reduction in the amount of coolant water required is particularly important for some metal producers who do not have an adequate water supply necessary for the water cooled systems currently available. Moreover, the scrubbing action of the sprays against the working plates keeps the plate surface clean, thereby enhancing cooling efficiency and prolonging the life of the furnance and/or components. In some prior art systems, scale and sludge tend to build up either in pipes or within the enclosed fabrication, requiring frequent cleaning or chemical treatment of the water in order to maintain efficient cooling.

The coolant fluid is preferably water or a water base fluid, and is sprayed in a quantity such that the spray droplets absorb heat due to surface area contact. If desired, thermocouples could be embedded in the plates to measure the temperature and these thermocouples could be connected with suitable controls to adjust the rate of coolant flow to maintain the desired temperature. The droplets of coolant fluid produced by the spray system contact a very large surace area, resulting in a large cooling capacity. Moreover, although the temperature of the coolant fluid (water) normally does not reach 212° F., if it does reach such temperature due to the occurrence of a temporary hot spot, or the like, it flashes, whereby the latent heat of vaporization of the coolant is used in cooling the working plates, resulting in a calorie removal approximately ten times that which can be achieved with flood cooling.

Significantly less maintenance is required with a spray cooling system that is required with prior art water flooded systems. For instance, if the water temperature exceeds about 140° F. in a prior art water flooded system, precipitates will settle out, causing scaling and buildup on the surface to be cooled, reducing cooling efficiency. Further, if the water temperature exceeds about 212° F. in a prior art system, steam can be generated, creating a dangerous situation with the possibility of explosion. As noted previously, the sprays of water have a scrubbing effect on the surface being cooled, tending to keep it clean of scale, etc. Moreover, the system of the invention can be used with sufficient pressure to effect a spray, and access to the cooling space or plates is convenient, enabling easy cleaning or repair when necessary. Water flooded systems, on the other hand, comprise individual panels which must be removed and flushed to preserve their life. Also, water flooded systems require a substantial number of hoses, pipes, valves and the like to connect and disconnect and maintain. Further, the absence of a preconstructed refractory lining from the structure according to the invention eliminates both the weight and expensive and time-consuming maintenance required in furnaces with refractory linings.

DETAILED DESCRIPTION OF THE INVENTION

As used herein, vessels shall mean containers for handling heated substances such as vessels for handling molten materials, ducts for handling hot gases or liquids, elbows for handling hot gases or liquids, or the like. The present invention can ideally be utilized in various portions of vessels for handling molten materials, for example, in the roof, side or bottom walls of such vessels. The preferred embodiment of the present invention is shown in FIGS. 1, 2, 3, 4 and 5 of the drawings wherein there is shown an electric arc furnace and associated roof structure. Like numerals are used to identify like features throughout the figures.

Figure 1:
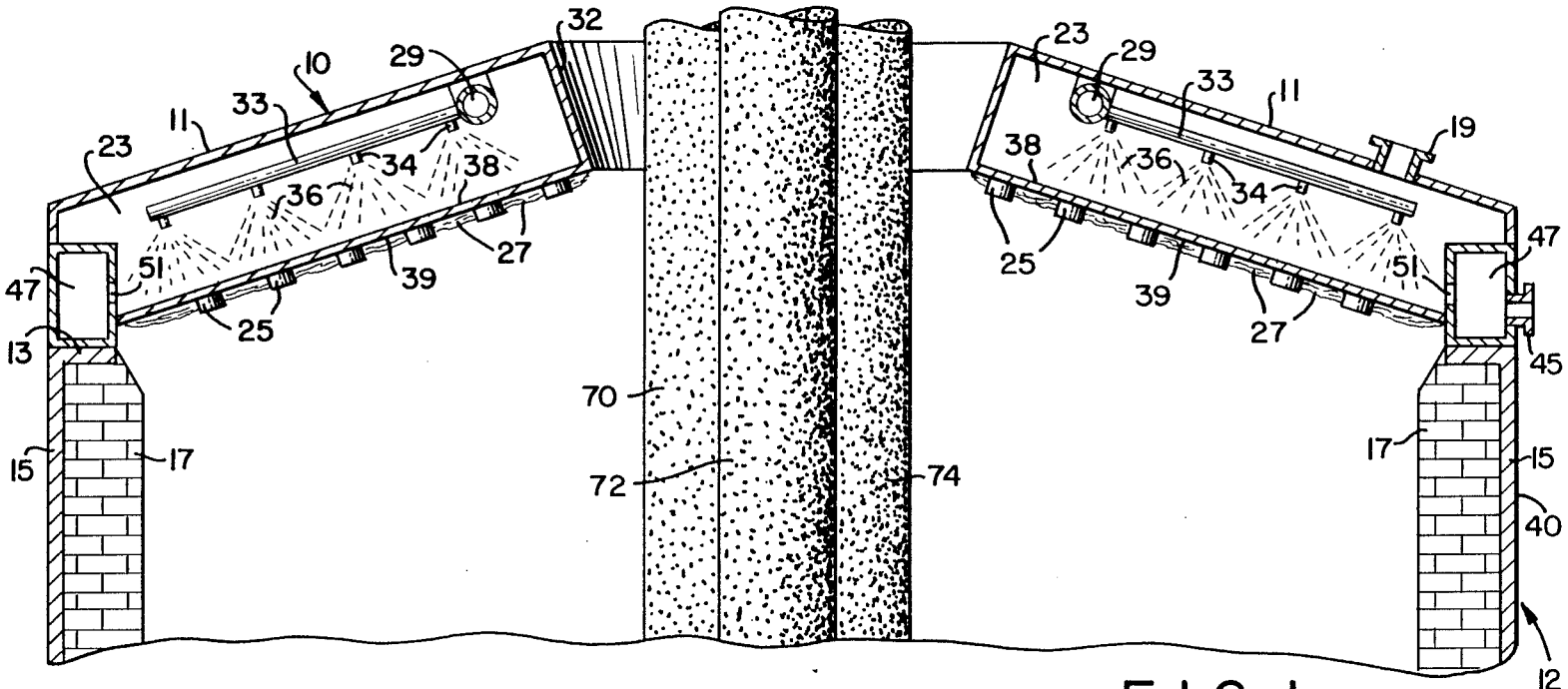
FIG. 1 is a cross-sectional side view of the upper portion of an electric arc furnace roof embodying the present invention.
Figure 2:
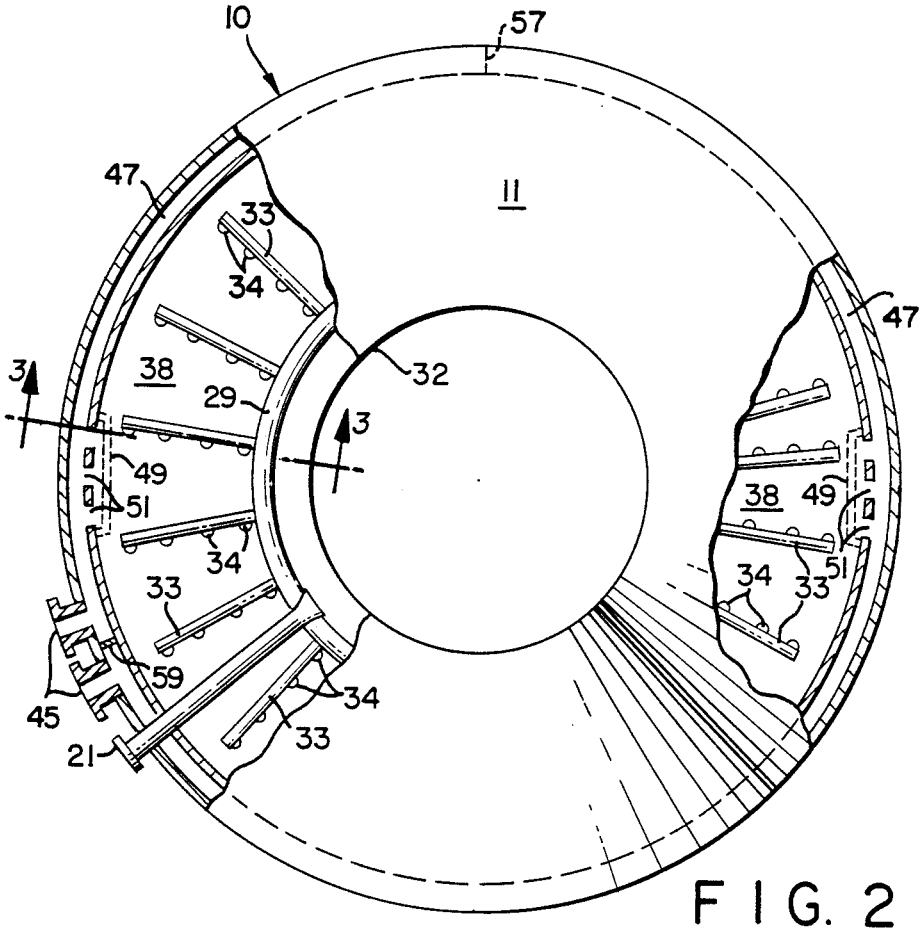
FIG. 2 is a plan view of an electric arc furnace roof of the present invention, partially cut-away and partially in section, showing the interior of the furnace roof.

A first preferred embodiment of the fluid cooled containment means of the present invention is shown in FIGS. 1 and 2. In this embodiment, the containment means comprises a circular electric arc furnace roof 10, shown in cross-section, sitting atop a typical electrical arc furnace 12. The portion of furnace 12 just below rim 13 consists of a steel furnace shell 15 lined by refractory brick 17 or other thermally insulating material. The furnace side wall above the melt line alternatively may be constructed, in accordance with the present invention, of inner and outer plates utilizing the internal spray cool system described below in conjunction with roof 10. Furnace roof 10 has a central electrode opening 32 accommodating three electrodes 70, 72 and 74, and a hollow interior section 23 between upper cover 11 and roof bottom 39. Within this interior space 23 there is a plurality of spoke-like cooling spray headers 33 which receive coolant from a central concentric ring-shaped water supply manifold 29 which extends around opening 32. Downward extending spray heads 34 spray the coolant 36 against the inside 38 of roof bottom 39 to maintain the roof at an acceptable temperature during melting or other treating of molten material in furnace 12. Coolant is removed from the roof interior via openings 51 in drain manifold 47 which extends around the lower outer periphery of the roof. Outlet 45 may be connected to an external drain line and permits draining of the coolant from manifold 47. As will be explained in more detail later, when a gas is injected into the roof interior 23 through gas inlet 19, the coolant is effectively removed through outlet 45.

During operation of furnace 12 in steel making, for example, the molten steel will be covered by molten slag or other protective material which tends to splash or spatter in various directions. As such spattered slag contacts the underside 39 of roof 10, portions will tend to solidify and adhere to the underside of the roof. When solidified, this slag acts as a thermally insulating layer which tends to lower the temperature of that portion of the roof which it covers. During normal operation of the furnace and roof assembly, the slag may tend to spall off at times, for example, when the roof is removed or otherwise when the roof underside is subject to cycling between hot and relatively cool temperatures. This same temperature cycling may occur, but to a lesser degree, when electric power to the electrodes in interrupted for furnace shutdown. As a consequence of this, the underside 39 of the roof, which is normally made up of steel plate or the like, is subject to thermal shock and stress which tends to create metal fatigue and ultimate cracking of the steel plates. To more securely trap and retain slag on the underside of roof 10, and to reduce the chance of spalling during thermal cycling or during removal of the roof from the furnace, a plurality of tubular projections 25 cover the roof underside 39. These projections 25, which will be explained in more detail later, are welded to the entire inner surface of the roof at spaced intervals and act as slag retention cups or sleeves. Slag spattering up from the melt will tend to form in situ an adherent thermally insulating refractory lining 27 around and within projections 25, as shown in FIG. 1. It should be noted that this lining 27 is not necessary for steady state temperature control of the roof underside 39, as the spray cooling system performs this task well. However, because of its usual formation, the present invention provides for the slag lining 27 to be made more adherent by the embedded projections 25 and consequently the roof is less subject to undesirable thermal stress.

Figure 4:
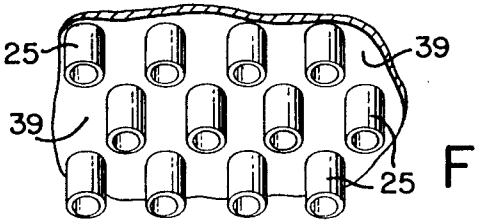
FIG. 4 is a perspective view of a portion of the underside of the furnace roof of FIG. 2.
Figure 5:
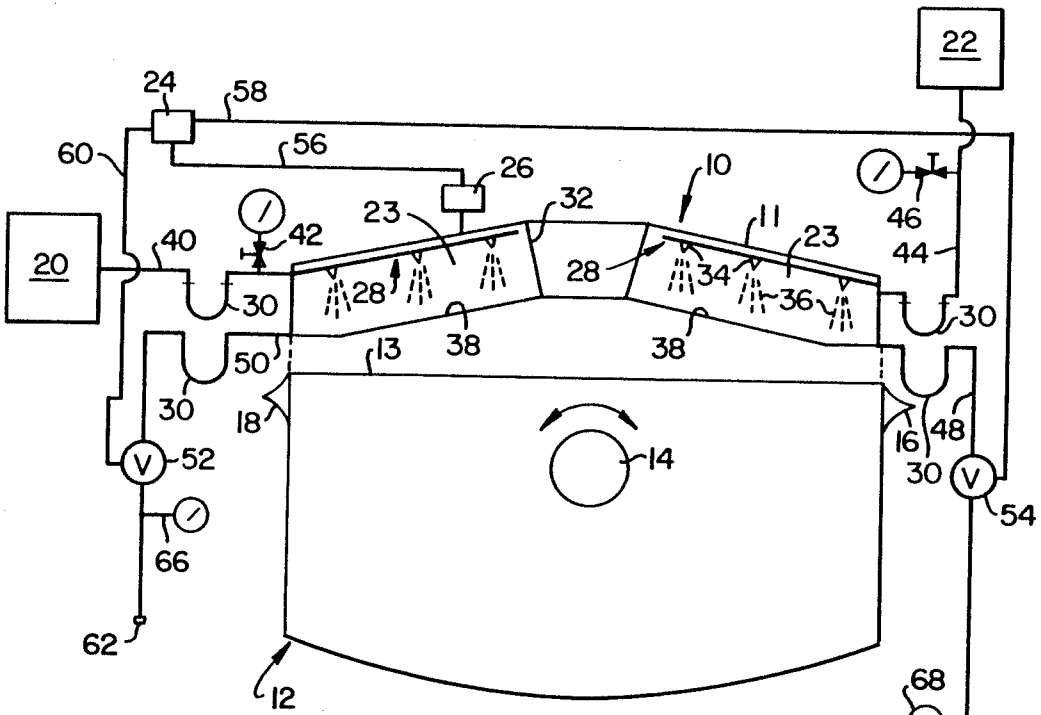
FIG. 5 is a schematic view of the side of an electric arc furnace utilizing an embodiment of the present invention.

Another preferred embodiment of the present invention is shown in FIGS. 2–5, wherein in FIG. 5 there is shown a side schematic view of another furnace assembly utilizing the present invention. A conventional electric arc furnace vessel 12 is typically used for melting and treating steel and other ferrous alloys. The furnace vessel 12 is supportable on trunions or an axis 14 which enables the furnace to be tilted in either direction as shown by the arrow. Typically, the furnace is able to tilt in one direction to pour off slag via a slag spout 18. Directly opposite slag spout 18 is tap spout 16 on the opposite side of furnace 12 which is used to tap or pour the molten steel as the furnace is tilted in the opposite direction once the melting and treating process is completed.

In a partially exploded view, furnace roof 10 is shown raised from its usual position sitting atop furnace rim 13. Furnace roof 10 is slightly conical in shape and includes at its apex a central opening 32 for inserting one or more electrodes into the furnace interior. Typically three electrodes are utilized with a so-called "delta" supporting structure which may fit into roof opening 32 as shown in FIG. 1. Roof 10 is comprised of an upper, outer wall 11 and a lower, inner wall 38 which is exposed on its underside 39, (FIG. 3) to the interior of the furnace. The outer and inner walls, 11 and 38, respectively, define the interior space 23 of the roof. Roof 10 does not contact the molten steel directly but serves to contain the gases and other emission products from the steel bath during process of the steel inside the furnace.

To protect the underside of furnace roof 10 from the intense heat emitted from the interior of furnace 12 there is provided a coolant spray system 28 which supplies a coolant to the space 23 between the upper and lower walls of the roof. The spray system utilizes a coolant such as water or a waterbased liquid which is supplied preferably at ambient temperature under elevated pressure from a coolant supply 20. Coolant supply line 40 carries the coolant through hose connection 30 and pressure control 42 to the spray system 28 whereupon it is sprayed through spray heads or nozzles 34 in controlled spray patterns 36 against the interior portion of the roof lower wall 38.

Figure 3:
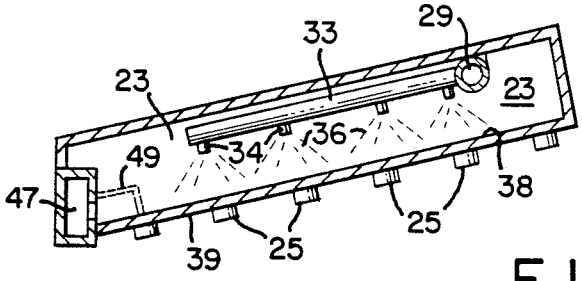
FIG. 3 is a side elevational view of the portion of the furnace roof along lines 3—3 of FIG. 2.

As shown in more detail in FIGS. 2 and 3, the coolant from supply line 40 enters roof 10 through a supply inlet 21 which communicates with spray manifold 29. Spray manifold 29 extends in the interior of the roof substantially completely around opening 32 and distributes the coolant to individual headers 33 extending radially outwardly and which carry the spray heads 34. The action of the coolant spray patterns 36 downward against the entire upper surface of inner wall 38 serves to cool wall 38 and protect against the heat generated from the melt and gases in furnace 12. Thermocouple or other temperature sensing means (not shown) may be utilized to monitor the temperature of wall 38. The amount of coolant sprayed against wall 38 is controlled to maintain a desired temperature at the inner wall and is normally adjusted so that the temperature of wall 38 is below 212° F. (100° C.) so that the coolant droplets do not flash into steam under normal conditions. The high surface area of the coolant drops, combined with the volume of coolant utilized, serves to effectively and efficiently remove heat from wall 38 as described above.

To remove the coolant after it is sprayed onto the inside of wall 38, there is provided a draining or evacuation system comprising drain manifold 47 which extends around the periphery of the interior of roof 10. Drain manifold 47 is made of rectangular tubing, split by walls 57 and 59 into two separate sections, and utilizes elongated slots 51 or other spaced openings along the lower inner facing wall portion which receive the spent coolant from the slanted lower wall 38. Spent coolant should be drained as quickly as possible so that there is a minimum of standing coolant over the lower wall 38 to minimize interference with the spray of coolant directly against wall 38. All of the manifold openings or coolant outlets 51 will preferably be covered by screen 49 to prevent debris from entering the manifold and blocking the removal of coolant. Coolant is then removed via discharge outlet 45 (FIG. 2) from the respective sections of manifold 47 to drain lines 48 and 50 and expelled through outlets 62 and 64 (FIG. 5).

So that the spent coolant may be quickly removed and drained from the interior 23 of roof 10, there is provided a means for establishing and maintaining a pressure differential between the interior of the furnace roof and the coolant outlet. As used herein, this "means for maintaining a pressure differential" refers to and comprises a system wherein a gaseous medium is injected into and pressurizes the space above the sprayed coolant to force the coolant out of the roof drain. As shown in FIG. 5, a pressurized gas supply 22 is connected via a gas supply line 44 to the interior of roof 10 to supply a gas such as air or nitrogen thereto. The pressure of such gas in the roof interior 23 should be maintained intermediate the pressure of the coolant at the spray heads 34 and the pressure of the spent coolant at the coolant outlets 62, 64 such that $P_1 > P_2 > P_3$ where $P_1$ equals the coolant spray head pressure, $P_2$ equals the gas pressure in the interior of the roof, and $P_3$ equals the coolant outlet pressure. Normally, the coolant is water supplied at normal tap pressure $P_1$ of 35 lb./in.$^2$ (gauge) or higher. Preferably, the gas pressure $P_2$ is from about 0.1 to 20 lb./in.$^2$ above the coolant outlet pressure $P_3$, which is normally at atmospheric pressure (one atmosphere) or slightly higher, as indicated at pressure gauges 66 and 68.

To provide for a controlled gas pressure in the interior space of the furnace roof 10, it will be generally necessary to seal the various panels and sections of the roof structure to prevent excessive escape of gas. It is not considered necessary to make the roof structure completely gas tight, however it is desirable to use appropriate gaskets or other sealants to minimize such gas leakage so that the roof is substantially gas tight.

In utilizing the present invention, it is recommended that drain lines 48 and 50 be sealed with the liquid coolant to avoid an undesirable loss of pressurizing gas within the roof interior 23 through a coolant outlet. To provide for the fact that roof 10 tilts along with the electric furnace vessel 12 during both deslagging and tapping, the present invention also provides a control system to prevent such loss of roof interior gas pressure during tilting of the combined furnace and roof structure. This control system utilizes means to detect or signal that the furnace 12 has tilted to elevate one of the manifold openings or coolant outlets 51 to a degree that would prevent spent coolant from flowing into the elevated manifold opening or coolant outlet 51 which would provide an escape outlet for the pressurizing gas. This would effectively cause loss of pressure within the roof interior 23 that could be sufficient to prevent the adequate discharge of the spent coolant. An activator is provided that will close a valve in the elevated outlet drain line to prevent loss of interior pressure when the furnace 12 is tilted.

As shown in FIG. 5, a tilt sensor 26 is connected to or otherwise associated with furnace roof 10 to detect when the furnace roof is tilted from its normal horizontal position. As the furnace roof is tilted in either direction, the liquid coolant will tend to flow away from the uppermost of the opposite tap and slag side drain lines, 48 and 50, respectively. The gas pressure inside the roof will then tend to force the remaining coolant in the drain line 48 or 50 from the uppermost drain and thereby permit the gas overpressure inside the roof to be diminished. To prevent such loss of pressure a valve controller or actuator 24 is connected via circuit 56 to the tilt sensor 26. Should the tilt sensor for example signal that the tap side drain line 48 has been elevated, such as may occur during a deslagging operation, controller 24 will signal via circuit 58 the tap side drain valve 54 to close, thereby preventing any loss of gas pressure through the tap side drain line 48. Once the furnace regains its horizontal position, the controller 24 will signal the drain line valve 54 to open to resume draining from that side of furnace roof 10. During tapping of the molten material from furnace 12, the slag side drain line 50 will be elevated and exposed, and the controller will then signal the slag side drain valve 52, via circuit 60, to close. Accordingly, the tilt sensor 26 and the associated controllers and drain line valves will serve to maintain the desired gas pressure inside furnace roof 10 during all stages of processing. It should be noted that furnace roof 10 may be segmented into two or more compartments or sections, each with its own separate spray system and coolant outlets. Likewise, side or bottom walls of vessels utilizing the cooling system of the present invention may also be so segmented.

The slag retaining tubular projections 25, discussed previously in connection with the embodiment of FIG. 1, are shown in more detail in FIGS. 3 and 4 without adhered slag. These projections may be made of hollow steel pipe segments, for example 1 and ½ inches (38 mm) diameter by 1 and ¼ inches (32 mm) length, which are welded at spaced intervals along the entire underside 39 of roof 10. The tubular configuration of the projections 25 enables slag to adhere to both the inner and outer pipe surfaces so that when the slag builds up and completely covers the projection, the solidified slag adheres more firmly than it would, for example, with a solid projection. This increased adhesion prevents slag from spalling as a result of mechanical shock during roof movement and/or thermal shock as the roof is alternately heated and cooled. In conjunction with the spray cooling system 28, the furnace roof 10 can be maintained at less varying, controlled temperatures.

Thus, the present invention provides for simple, high efficiency cooling for the inner surface of various types of closed-bottom vessels such as the arc furnace shown in the drawings, as well as other types of melt furnaces, ladles, and the like. Additionally, the relatively low pressure in the containment means interior minimizes the risk of coolant leakage into the vessel. The present invention provides such cooling efficiency that it is generally unnecessary to install any type of refractory or other thermal insulation along the inner wall 39 of the containment means, although it may be desirable to place some type of thin coating thereon as protection from the corrosive nature of the hot gases that may be generated in the vessel interior. Although not needed for thermal insulation per se, the hollow tubular projections can retain any spattered slag or other material thus providing an adherent protective barrier which is formed in situ which will prolong vessel life through the reduction of thermal stress to the inner wall of the containment means.

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

What is claimed is:

1. A vessel for handling a heated substance, said vessel having fluid cooled containment means comprising:
- inner and outer walls defining a space therebetween;
- inlet means for bringing coolant to spray means within said space for spraying the coolant against the inner wall to maintain a desired temperature at said inner wall;
- an outlet for removing the spent coolant; and
- pressure differential means comprising means for injecting a gas into said space for maintaining a pressure differential between said space and said coolant outlet to force the spent coolant out of said space through said outlet.

2. The vessel of claim 1 wherein said gas is selected from the group consisting of air and nitrogen.

3. The vessel of claim 1 wherein said pressure differential means comprises means for maintaining said space at a pressure above one atmosphere and below that of said pressurized coolant.

4. The vessel of claim 1 wherein the walls of said containment means are substantially gas tight.

5. The vessel of claim 1 wherein said vessel comprises a bottom wall, a side wall and a cover for said vessel, and wherein said fluid cooled containment means defines at least a portion of one of said side wall and said cover.

6. The vessel of claim 5 wherein said fluid cooled containment means defines at least a portion of said side wall.

7. The vessel of claim 1 wherein said containment means includes a plurality of said coolant drain lines, and means for selectively closing one or more of said drain lines.

8. The vessel of claim 7 further including means to sense tilting of said vessel containment means and elevation of one of said coolant outlets relative to another of said coolant outlets, and means to selectively close the elevated cooling outlet in response to such tilting.

9. The vessel of claim 1 further including tubular projections extending from said inner wall toward the interior of said vessel for retaining solidified portions of molten material which contact said inner wall.

10. A liquid-cooled cover for a vessel for molten materials, said cover comprising substantially gas tight inner and outer walls defining an interior space therebetween; an inlet into said interior space for a pressurized liquid coolant; inlet means for bringing coolant to spray means within said interior space for spraying said coolant against said inner wall to cool said wall; an outlet for removing the spent coolant; and pressure differential means for maintaining said interior space at a pressure above one atmosphere and between that of said pressurized coolant and said outlet to force the spent coolant out of said interior space through said outlet.

11. The cover of claim 10 wherein said gas is selected from the group consisting of air and nitrogen.

12. The cover of claim 10 including a plurality of said coolant outlets, and further including means to sense tilting of said cover and elevation of one of said coolant outlets relative to another of said coolant outlets, and means to selectively close the elevated coolant outlet in response to such tilting.

13. The cover of claim 10 wherein said molten material in said vessel is covered by slag, and further including tubular projections extending downward from said inner wall for retaining solidified portions of slag which contact said inner wall.

14. A roof for a metallurgical melt furnace comprising upper and lower walls defining an interior space therebetween, means in said roof interior for spraying a pressurized coolant against said lower wall to provide cooling and maintain said lower wall at a desired temperature; a pair of coolant outlets to permit draining of spent coolant from said lower wall; means for maintaining a pressure differential between said roof interior and said coolant outlets to force the spent coolant out of said roof interior through said coolant outlets; and means for selectively closing one of said coolant outlets responsive to tilting of said roof and elevation of said one of said coolant outlets above the other of said coolant outlets.

15. The furnace roof of claim 14 wherein said upper and lower walls are substantially gas tight and wherein said pressure differential means comprises means for injecting a gas selected from the group consisting of air and nitrogen into said roof interior at a pressure between that of said pressurized coolant and said coolant outlets.

16. The furnace roof of claim 14 further including means for sensing tilting of said roof, and wherein said selective coolant outlet closing means is operable to close either of said coolant outlets in response to the tilt sensing means.

17. The furnace roof of claim 16 wherein said pressure differential means comprises means for injecting a gas into said roof interior at a pressure between that of said pressurized coolant and said coolant outlets.

18. The furnace roof of claim 14 further including tubular projections extending downward from said lower wall for retaining solidified portions of slag in said furnace which contacts said lower wall.

19. A method of cooling a vessel for handling a heated substance, said vessel including fluid cooled containment means comprising inner and outer walls defining a space therebetween and an inlet and outlet in said space for the fluid coolant, said method comprising the steps of:

(a) injecting a pressurized fluid coolant through said inlet into spray means for spraying said coolant against said inner wall to maintain a desired temperature at said inner wall; and (b) injecting a gas into said space for maintaining a pressure differential between said space and said coolant outlet to force spent coolant out of said space through said outlet.

20. The method of claim 19 wherein said gas is selected from the group consisting of air and nitrogen.

21. The method of claim 19 wherein said pressure differential is created by maintaining said space at a pressure above one atmosphere and below that of said pressurized coolant.

22. The method of claim 21 wherein said space is maintained at a pressure from about 0.1 to 20 lb./in$^2$ above that of said coolant outlet.

23. The method of claim 19 wherein said containment means includes a plurality of said coolant outlets and said method further comprising the steps of:

(c) sensing the tilting of said containment means and the elevation of one of said coolant outlets relative to another of said coolant outlets; and (d) thereafter closing the elevated coolant outlet.

24. The method of cooling a vessel for handling a heated substance, said vessel including liquid cooled containment means comprising inner and outer walls defining a space therebetween and an inlet and a plurality of coolant outlets in said space for the liquid coolant, said method comprising the steps of:

(a) injecting a pressurized liquid coolant through said inlet into spray means for spraying said coolant against said inner wall to cool said inner wall;

(b) injecting a gas selected from the group consisting of air and nitrogen into said space at a pressure between that of said pressurized coolant and said coolant outlet to create a pressure differential and force spent coolant out of said space through said coolant outlets;

(c) sensing the tilting of said containment means and the elevation of one of said coolant outlets relative to another of said coolant outlets; and (d) thereafter closing the elevated coolant outlet.

25. The method of claim 24 wherein said gas is injected in step (b) at a pressure from about 0.1 to 20 lb./in$^2$ above atmospheric.

* * * * *